US006763687B2

(12) United States Patent
Jo et al.

(10) Patent No.: US 6,763,687 B2
(45) Date of Patent: Jul. 20, 2004

(54) WASHING MACHINE

(75) Inventors: Seong Jin Jo, Kyongsangnam-do (KR); Gi Hyeong Do, Kyongsangnam-do (KR); Bon Kwon Koo, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/879,169

(22) Filed: Jun. 13, 2001

(65) Prior Publication Data

US 2001/0049948 A1 Dec. 13, 2001

(30) Foreign Application Priority Data

| | | |
|---|---|---|
| Jun. 13, 2000 | (KR) | 2000-32471 |
| Oct. 17, 2000 | (KR) | 2000-61047 |
| Nov. 9, 2000 | (KR) | 2000-66360 |
| Nov. 9, 2000 | (KR) | 2000-66361 |
| Nov. 23, 2000 | (KR) | 2000-69844 |

(51) Int. Cl.[7] ..... D06F 33/02
(52) U.S. Cl. ..... 68/12.01; 68/12.02; 68/12.12
(58) Field of Search ..... 68/12.01, 12.02, 68/12.12, 12.16, 12.27

(56) References Cited

U.S. PATENT DOCUMENTS

| | | | | |
|---|---|---|---|---|
| 4,104,542 A | | 8/1978 | Karklys et al. | 307/141 |
| 4,184,347 A | | 1/1980 | Tobita et al. | 68/12 R |
| 4,735,219 A | * | 4/1988 | Seeland | |
| 4,977,394 A | * | 12/1990 | Manson et al. | |
| 4,982,468 A | * | 1/1991 | Takahashi et al. | 8/159 |
| 5,038,807 A | * | 8/1991 | Bailey et al. | |
| 5,150,489 A | * | 9/1992 | Kaji et al. | 8/159 |
| 5,235,827 A | * | 8/1993 | Kiuchi et al. | |
| 5,241,845 A | * | 9/1993 | Ishibash et al. | |
| 5,390,385 A | | 2/1995 | Beldham | |
| 5,400,246 A | * | 3/1995 | Wilson et al. | |
| 5,424,940 A | | 6/1995 | Ousborne | |

(List continued on next page.)

FOREIGN PATENT DOCUMENTS

| | | | |
|---|---|---|---|
| GB | 2 277 531 A | | 2/1994 |
| JP | 59-37988 | * | 3/1984 |
| JP | 59-183407 | | 10/1984 |
| JP | 60-99291 | * | 6/1985 |

(List continued on next page.)

*Primary Examiner*—Frankie L. Stinson
(74) *Attorney, Agent, or Firm*—Fleshner & Kim, LLP

(57) ABSTRACT

Disclosed is a washing machine capable of changing program and solving a fundamental problem of malfunction. The washing machine includes: a storage tank mounted vertically or horizontally for storing washing water; an inner tub mounted vertically or horizontally inside the storage tank in a rotatable manner; a load part including a motor for rotating the inner tub, water supply means for supplying water and drain means for draining water; a drive micom for controlling the load part; a key input part for allowing a user to input various operation orders or to set functions of the washing machine; a display part for displaying the functions and operation conditions; a memory capable of reading and writing and for storing operation algorism of the washing machine and information related with the washing machine; an interface part for inputting and outputting data with an external device; and a system micom for controlling the drive micom for performing a washing operation corresponding to the user's operation order through the key input part, controlling the display part for displaying the corresponding operation condition or function and storing data transferred from the external device through the interface part into the memory. The washing machine can maximize convenience, washing performance and operational efficiency.

21 Claims, 3 Drawing Sheets

U.S. PATENT DOCUMENTS 5,511,397 A * 4/1996 Makino et al.
5,611,327 A 3/1997 Teixeira Filho et al. ..... 126/39
5,619,614 A 4/1997 Payne et al. ..... 395/3
5,647,231 A * 7/1997 Payne et al.
5,757,643 A * 5/1998 Kuroda et al.
5,839,097 A * 11/1998 Klausner
5,897,671 A 4/1999 Newman et al.
5,960,804 A * 10/1999 Cooper et al.
5,987,105 A 11/1999 Jenkins et al. ..... 379/106.01
6,167,358 A * 12/2000 Othmer et al.
6,241,782 B1 * 6/2001 Vandehar

FOREIGN PATENT DOCUMENTS

| | | | |
|---|---|---|---|
| JP | 1-195897 | * | 8/1989 |
| JP | 5-57100 | * | 3/1993 |
| JP | 5-208090 | | 8/1993 |
| JP | 8-66576 | | 3/1996 |
| JP | 9-298773 | * | 11/1997 |
| JP | 11-146991 | * | 6/1999 |

* cited by examiner

WASHING MACHINE

BACKGROUND OF THE INVENTION

1. Field of the Invention

The present invention relates to a washing machine, and more particularly, to a washing machine capable of increasing convenience in use, improving a washing performance and improving an operational efficiency by grasping causes of malfunction of a product in itself, problems in installation, problems in regional peculiarity and a change in a user' living patterns and by properly corresponding to them.

2. Discussion of the Related Art

In general, a washing machine is to remove pollutants from the polluted laundries through processes of washing, rinsing and dehydrating operations according to a preset algorism. The washing machine is divided into an automatic washing machine using a horizontal, rotation of rotary blades, an inner tub or an outer tub (wash tub/dehydration tub) and a drum washing machine using a vertical rotation of a drum.

Such washing machines are developed in various washing courses and functions to correspond to users' various desires and applied to various products.

As shown in FIG. 1, a conventional washing machine includes a motor 10 for directly or indirectly rotating washing blades, an inner tub or an outer tub, loads 11 such as a water supply valve and a drain valve, a key input part 12 for allowing the user to input various laundry operation orders related with washing, a display part 13 for displaying operation conditions or functions of the washing machine, and a system micom 14 for controlling operations of the motor 10 and the load 11 to perform washing motion corresponding to the user's operation order input though the key input part 12 and for controlling the display part 13 to display the corresponding operation condition or function.

At this time, A LED (Light Emitting Diode) is used for the display part 13 and the system micom 14 has a ROM storing unchangeable programs concerning the washing.

An operation of the conventional washing machine will be described as follows.

The user turns on a power source of the washing machine, inserts the laundries into the washtub and inputs washing order through the key input part 12. After that, the system micom 14 recognizes the washing order, reads the corresponding program from the ROM inside the system micom 14, and operates the motor 10 and various loads 11 based on the program to perform washing. The micom 14 controls the display part 13 to display the present washing progress state.

The conventional washing machine cannot show its performance due to not only mechanical trouble of the product in itself but also inharmoniousness between the embedded programs and various use environments. Moreover, in the conventional washing machine, there are lots of problems that the users demand repair of the washing machine by mistaking the inharmoniousness as a malfunction, and a service man who repairs the washing machine cannot grasp causes of the malfunction.

The inharmoniousness between the embedded programs and various use environments will be described. Because of hardness of water, there is often a case that the user is not satisfied with the laundry performance even though there is no trouble in the product in itself. That is, the washing performance is largely influenced also by a difference of the hardness of water (hard water/soft water). To improve the washing performance, it is required to accommodate the program to the use environments by changing the control program of a rotating angle of the washing blades and a washing period of time. However, the conventional washing machine cannot change the set programs.

Furthermore, the kinds of the laundries differ according to a change of the user's family members. For example, a new married couple washes the laundries through a standard washing of the washing machine. But, if there is a child or a baby, the laundries such as diapers requiring sanitation occur. Thus, for the sanitation, a program having strengthened rinsing performance must be applied, but the conventional washing machine cannot change the programs.

As described above, the conventional washing machine, which cannot change the programs, cannot solve the problems, such as the change of life patterns.

Next, there is a case that a problem due to the use environments not defects of the product in itself is mistaken as the malfunction of the product. In this case, the service man cannot often find the cause of the problem, and thereby, cannot repair unsuitably. For example, in a dehydration, stoke, there is a case that the washtub does not rotate or rotates in a low speed and thus the dehydration cannot be performed. It is the reason that the motor in itself is malfunctioned or that the motor is damaged due to overload by restricting the rotation of the washtub by tension of excessively lots of bubbles generated by overcharge of a detergent. However, in this case, the service man cannot grasp the cause of the malfunction or damage, and thereby cannot find measures against the malfunction or damage.

Additionally, if a water supply time for washing is lengthened due to problems, such as water pressure of the home in which the washing machine is installed, an installation position (high elevated area/low area), a water supply method and others, the user recognizes abnormality in water supply and notifies a manufacturer of the abnormality. In this case, the service man checks the water supply valve. However, if the water supply valve is not out of order, the service man cannot grasp the cause of the abnormality.

In that case, the service man can take the optimum measures by analogizing and explaining the malfunctions of the product or components or the use environments mistaken as the malfunction, if knowing detailed use records and malfunction records of the washing machine. However, because the conventional washing machine does not give the use records, the malfunction records and, operational condition records thereof, the service man cannot grasp the causes of the malfunction and cannot take proper measures.

Therefore, the conventional washing machine has the following problems.

First, because the washing machine cannot store the use records, the malfunction records and the operational condition records thereof, the causes of the malfunction are not grasped. So, if only the corresponding component is replaced, namely, only with measures on hardware, it cannot be prevented that the same problems occur.

Second, if the unchangeable washing programs are applied to a low capacity memory, not the malfunction, of the product in itself but the problems due to the installation, the regional peculiarity and the change of life patterns cannot be solved.

SUMMARY OF THE INVENTION

Therefore, it is an object of the present invention to provide a washing machine capable of replacing or changing set programs with programs suitable for a change of family members, a change of life patterns and a change of season.

It is another object of the present invention to provide a washing machine capable of completely solving malfunctions by grasping use records of the washing machine and use records of each component of the washing machine and grasping causes of the malfunctions.

It is a further object of the present invention to provide a washing machine capable of obtaining washing information for a more developed washing machine by grasping washing patterns preferred by users, washing records and causes of malfunction.

To achieve the above objects, the present invention provides a washing machine including: a storage tank mounted vertically or horizontally for storing washing water; an inner tub mounted vertically or horizontally inside the storage tank in a rotatable manner; a load part including a motor for rotating the inner tub, water supply means for supplying water and drain means for draining water; a drive micom for controlling the load part; a key input part for allowing a user to input various operation orders or to set functions of the washing machine; a display part for displaying the functions and operation conditions; a memory capable of reading and writing and for storing operation algorism of the washing machine and information related with the washing machine; an interface part for inputting and outputting data with an external device; and a system micom for controlling the drive micom for performing a washing operation corresponding to the user's operation order through the key input part, controlling the display part for displaying the corresponding operation condition or function and storing data transferred from the external device through the interface part into the memory.

BRIEF DESCRIPTION OF THE ATTACHED DRAWINGS

Further objects and advantages of the invention can be more fully understood from the following detailed description taken in conjunction with the accompanying drawing in which.

DETAILED DESCRIPTION OF THE PREFERRED EMBODIMENTS

Figure 1:
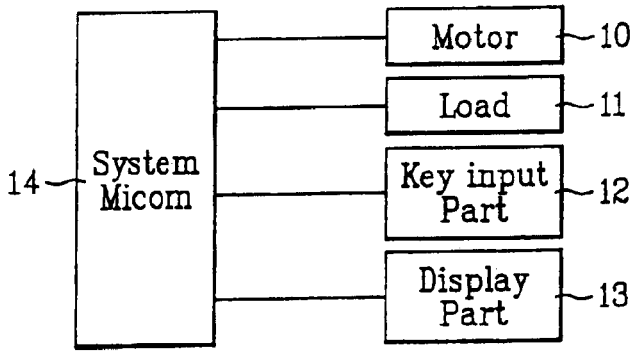
FIG. 1 Related Art
FIG. 1 is a block diagram of a structure of a conventional washing machine.

The present invention will now be described in detail in connection with preferred embodiments with reference to the accompanying drawings. For references like reference characters designate corresponding parts throughout several views.

A first preferred embodiment of the present invention would be described hereinafter in detail.

Figure 2:
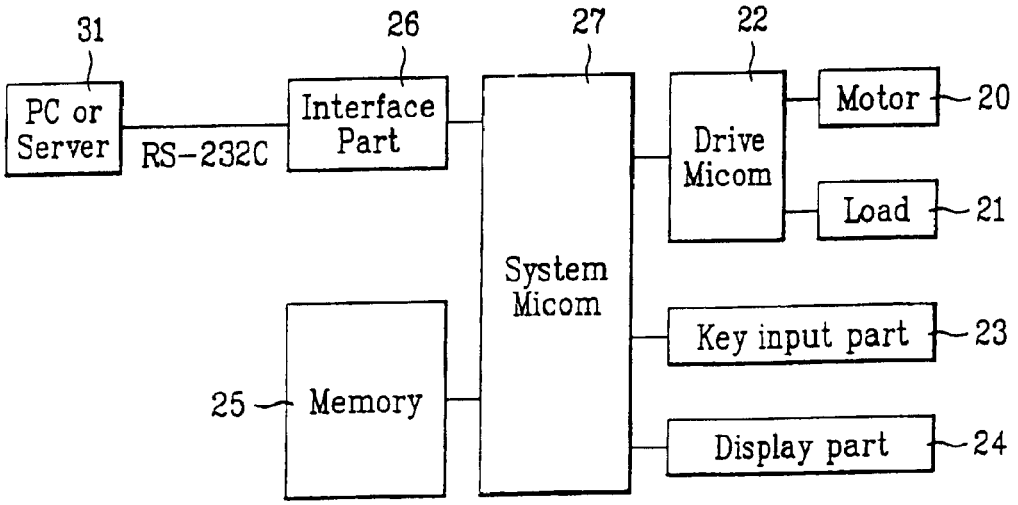
FIG. 2 is a block diagram of a structure of a washing machine according to a first preferred embodiment of the present invention.

As shown in FIG. 2, a washing machine of the first embodiment of the present invention includes: a motor 20 for actuating an inner tub, an outer tub, washing blades or a drum of the washing machine, various loads 21 such as water supply valve, drain valve, a water supply pump and so on; a drive micom 22 for controlling the operation of the motor 20 and the loads 21 and for reading operational condition records or operation records of the motor 20 and the loads 21; a key input part 23 for allowing a user to input various operation orders or setting various functions; a display part 24 for displaying functions and operational conditions of the washing machine; a memory 25 for storing information related with the washing machine including operation algorisms and use records of the washing machine; an interface part 26 for performing data conversion for data exchange with an external devices connected according to RS-232C communication standard, i.e., a PC (Personal Computer) or server 31; and a system micom 27 for controlling the drive micom 22 for a washing operation corresponding to the user's operation order through the key input part 23, controlling the display part 24 for displaying the corresponding operation condition or function and storing information related with the washing machine transferred through the drive micom 22 or data transferred from the PC 31 through the interface part 26 or uploading information stored in the memory 25 to the PC 31.

At this time, a flash ROM may be used as the memory 25. The flash ROM is increased in its volume wider than a conventional ROM, and, for example, uses volume of about 4M(Mega) bit. The display part 24 uses an LED (Light Emitting Diode) or an LCD (Liquid Crystal Display). Furthermore, a communication port may be added for connection with he PC or the server 31.

An operation of the washing machine according to the present invention will be described as follows.

The user turns on a power source of the washing machine, inserts the laundries into a washtub, and then inputs washing order through the key input part 23.

Then, the system micom 27 recognizes the washing order, reads the corresponding washing program from the memory 25, and transfers operation signal to the drive micom 22 for actuating the motor 20 and the loads 21.

The drive micom 22 actuates the motor 20 and the loads 21 according to the operation signal transferred from the system micom 27 to perform washing.

The system micom 27 controls the display part 24 to display the present washing progress state. The drive micom 22 transfers the use records of the motor 20 and the loads 21 to the system micom 27.

That is, data of temperature rise and of speed of the motor, water supply time and drain time are stored in the memory 25 through the system micom 27.

The system micom 27 stores related matters of washing stroke, which are selected by the user, into the memory 25 and stores also data of stroke, which is re-executed due to the user's dissatisfaction of the present washing stroke, into the memory 25.

Moreover, the system micom 27 reads the data stored in the memory 25 periodically or reads when the washing machine gets out of order and directly uploads the read data to the PC or the server 31 connected through the interface part 26.

Therefore, a service man of a manufacturer can monitor the uploaded data through the PC or the server 31, grasp causes of malfunctions of the product using related programs stored in the PC or the server 31 and repair the product or guide the user to a proper washing course. The information uploaded into the washing machine can be utilized as information required for producing a new product later.

Because the memory 25, which can change the program by adopting the flash ROM of mass storage and capable of re-record, can download program related with washing stroke suitable for the user's environments on the basis of the uploaded data, or change the set program.

For example, in case of the user who is a new married couple, if a baby is born, laundries such as diapers are added. However, in a conventional washing stroke, a sanitary washing to a level demanded by the user cannot be not performed. Therefore, the program must be changed to strengthen a rinsing stroke of the conventional washing program through software or the service man supported by the manufacturer, or a new program, which gives priority to sanitation, must be added. At this time, for the download or the change of the programs, the service man connects the PC to the washing machine through the interface part 26, and then downloads a prescribed program or changes the set program.

Hereinafter, a second preferred embodiment of the present invention would be described as follows.

Figure 3:
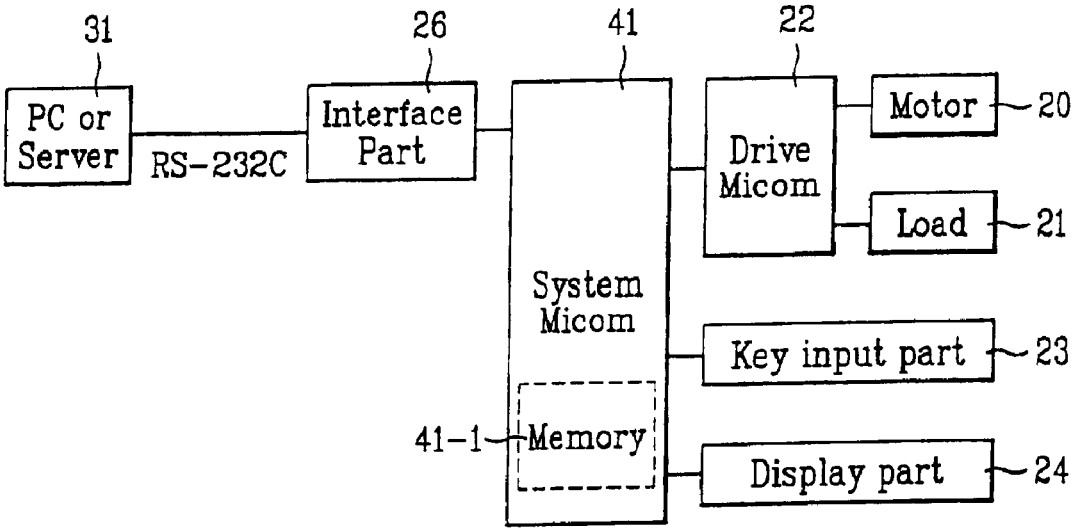
FIG. 3 is a block diagram of a structure of a washing machine according to a second preferred embodiment of the present invention.

As shown in FIG. 3, the washing machine according to the second embodiment uses a system micom 41 of a one-chip type embedding a memory 41-1. Besides the system micom 41, the second embodiment has the same structure as the first embodiment.

In the second embodiment, because the memory 41-1 is mounted inside the system micom 41, the washing machine can have a simplified circuit structure and effectively control data input/output.

Hereinafter, a third preferred embodiment of the present invention would be described as follows.

Figure 4:
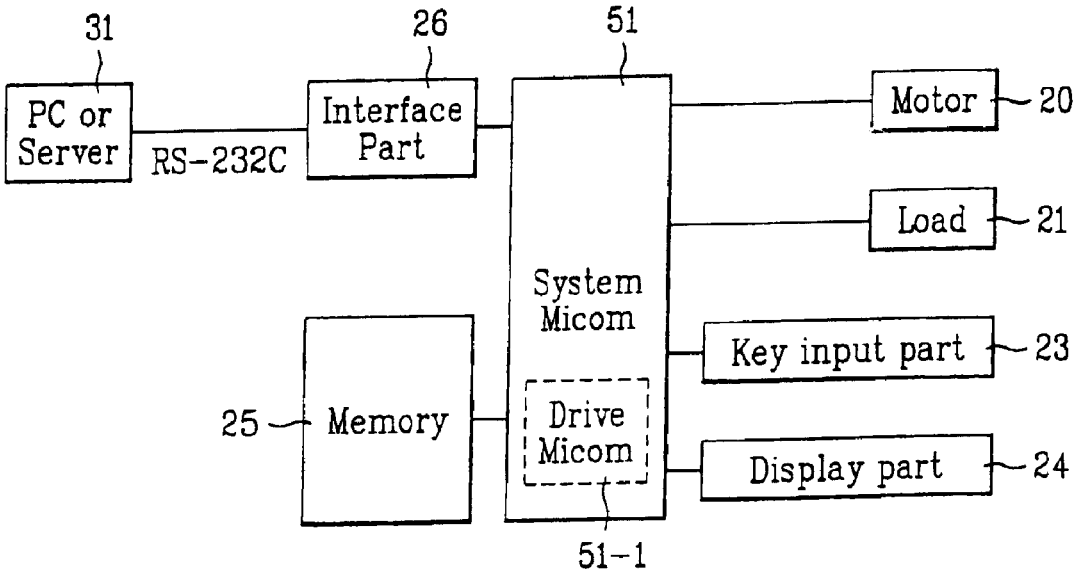
FIG. 4 is a block diagram of a structure of a washing machine according to a third preferred embodiment of the present invention.

As shown in FIG. 4, the washing machine according to the third embodiment uses a system micom 51 of a one-chip type embedding a drive micom 51-1. Besides the system micom 51, the third embodiment has the same structure as the first embodiment.

In the third embodiment, because the drive micom 51-1 is mounted inside the system micom 51, the washing machine can have a simplified circuit structure and improve a control of the washing machine system and a control performance and reliability of various information related with the washing machine by organic connection between the system micom 51 and the drive micom 51-1.

Hereinafter, a fourth preferred embodiment of the present invention would be described as follows.

Figure 5:
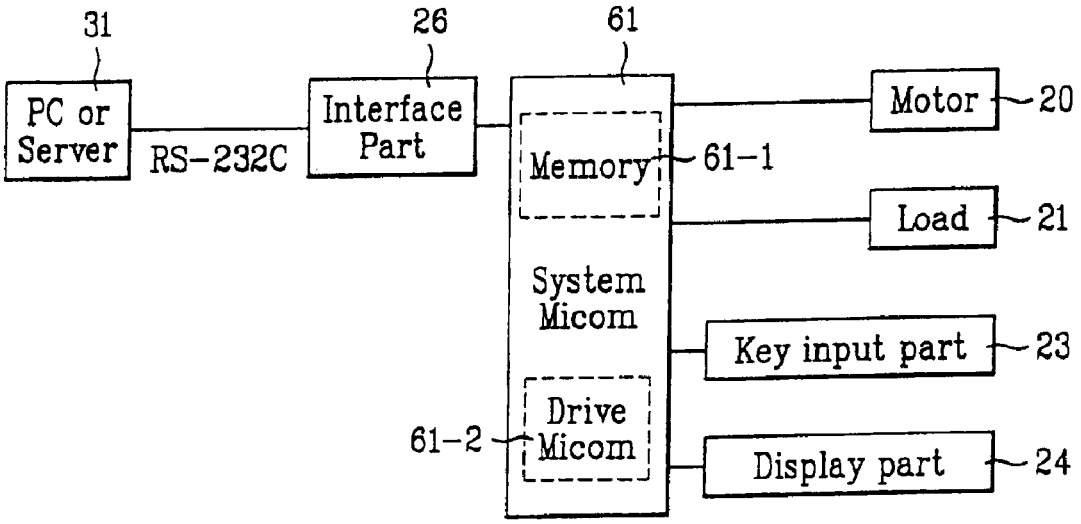
FIG. 5 is a block diagram of a structure of a washing machine according to a fourth preferred embodiment of the present invention.

As shown in FIG. 5, the washing machine according to the fourth embodiment uses a system micom 61 of a one-chip type embedding a memory 61-1 and a drive micom 61-2. Besides the system micom 61, the fourth embodiment has the same structure as the first embodiment.

In the fourth embodiment, because the memory 61-1 and the drive micom 61-2 are mounted inside the system micom 61, the washing machine can have a simplified circuit structure and effectively control data input/output of the memory 61-1 and the system micom 61. Furthermore, the washing machine can improve a control of the washing machine system and a control performance and reliability of various information related with the washing machine by organic connection between the system micom 61 and the drive micom 61-2.

As described above, the washing machine according to the present invention can optimize programs suitable for the user's environments by uploading the stored data of the use records and of the malfunction records of the product to the connected PC or server or by downloading information of the washing program from the PC or the server and replacing or changing the set program. Therefore, the washing machine can maximize convenience, washing performance and operational efficiency by treating not only the malfunctions of the product but also the malfunctions due to the external environments.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A washing machine, comprising:

a storage tank configured to store washing water;

an inner tub rotatably mounted within the storage tank;

a load part including a motor configured to rotate the tub, a water supply configured to supply water to the inner tub, and a drain configured to drain water from the inner tub; and a control system, the control system comprising:

a memory configured to store an operation history of the washing machine; and a system microprocessor configured to control operation of the load part of the washing machine based on at least the stored operation history of the washing machine, wherein the stored operation history of the washing machine comprises operation records, including use and malfunction records, and conditions of various loads of the load part.

2. The washing machine as claimed in claim 1, further comprising:

a user interface configured to allow a user to input user preferences, wherein the system microprocessor is configured to control operation of the load part based on user preferences input by the user.

3. The washing machine as claimed in claim 2, wherein the user interface comprises a key input.

4. The washing machine as claimed in claim 2, wherein user preferences include washing stroke.

5. The washing machine as claimed in claim 1, further comprising a display configured to display functions and operation conditions of the washing machine.

6. The washing machine as claimed in claim 5, wherein the display comprises one of a LED (light emitting diode) and an LCD (liquid crystal display).

7. The washing machine as claimed in claim 1, further comprising an external device interface configured to allow for data exchange with an external device.

8. The washing machine as claimed in claim 7, wherein the external device interface comprises a PC (personal computer) or a server.

9. The washing machine as claimed in claim 7, wherein the external device interface comprises a communication port.

10. The washing machine as claimed in claim 7, wherein the external device interface and the external device exchange data according to RS-232C communication standard.

11. The washing machine as claimed in claim 1, wherein the memory comprises a flash memory.

12. The washing machine as claimed in claim 1, wherein the operation records and conditions include data of one or more of temperature rise, speed of the motor, water supply time, water drain time, and out of order signals.

13. A washing machine, comprising:

a storage tank configured to store washing water;

an inner tub rotatably mounted within the storage tank;

a load part including a motor configured to rotate the tub, a water supply configured to supply water to the inner tub, and a drain configured to drain water from the inner tub;

a control system, the control system comprising:

a memory configured to store an operation history of the washing machine; and a system microprocessor configured to control operation of the load part of the washing machine based on at least the stored operation history of the washing machine; and a drive microprocessor configured to control the load part, wherein the system microprocessor communicates with the drive microprocessor to control operation of the load part of the washing machine based on at least the stored operation history of the washing machine.

14. The washing machine as claimed in claim 13, wherein at least one of the drive microprocessor and the memory is integrated into the system micron.

15. A washing machine, comprising:

a motor rotating an inner tub rotatably provided in an outer tub for containing a load of clothes, wherein the outer tub stores washing water;

a load part that includes at least one of a water supply system supplying water into the outer tub and a water drain system draining water from the outer tub;

a driver operating the motor and the load part according to a wash cycle option selected by a user;

a memory continuously storing the user-selected wash cycle option and operation history data of the motor and the load part; and a microprocessor configured to read the stored user-selected wash cycle option and stored history data from the memory and automatically upload them to an external device when connected thereto, wherein the microprocessor further automatically downloads new washer-operation values for one or more new wash cycle options from the external device and stores the downloaded new washer-operation values into the memory.

16. The washing machine of claim 15, wherein the operation history data includes at least one of a temperature of the motor, a speed of the motor, a water supply period, and a water drain period.

17. The washing machine of claim 15, wherein the microprocessor controls the operations of the motor and the load part according to one of the new wash cycle options.

18. The washing machine of claim 15, wherein at least one of the driver and the memory is integrated into the microprocessor.

19. The washing machine of claim 15, wherein the external device interface comprises a PC (personal computer) or a server.

20. The washing machine of claim 15, wherein the memory comprises a flash memory.

21. A washing machine, comprising:

a motor rotating an inner tub rotatably provided in an outer tub for containing a load of clothes, wherein the outer tub stores washing water;

a load part that includes at least one of a water supply system supplying water into the outer tub and a water drain system draining water from the outer tub;

a driver operating the motor and the load part according to a wash cycle option selected by a user;

a memory storing the user-selected wash cycle option and operation history data of the motor and the load part; and a microprocessor configured to read the stored user-selected wash cycle option and stored operation history data from the memory and automatically upload them to an external device when connected thereto, wherein the microprocessor further automatically downloads new washer-operation values for one or more new wash cycle options from the external device and stores the downloaded new washer-operation values into the memory.

* * * * *